US005490634A

United States Patent [19]

Jain et al.

[11] Patent Number: 5,490,634

[45] Date of Patent: Feb. 13, 1996

[54] BIOLOGICAL METHOD FOR COAL COMMINUTION

[75] Inventors: Mahendra K. Jain; Ramani Narayan, both of Okemos, Mich.; Ohantaek Han, Germantown, Wis.

[73] Assignee: Michigan Biotechnology Institute, Lansing, Mich.

[21] Appl. No.: 16,119

[22] Filed: Feb. 10, 1993

[51] Int. Cl.[6] ..... B02C 19/00

[52] U.S. Cl. ..... 241/1; 241/15; 241/30

[58] Field of Search ..... 241/1, 20, 15, 241/27, 22, 24, 30, DIG. 38, 29

[56] References Cited

U.S. PATENT DOCUMENTS

| | | | |
|---|---|---|---|
| 3,617,003 | 11/1971 | Winegartner | 241/16 |
| 3,897,010 | 7/1975 | Weishaupt et al. | 241/5 |
| 4,244,530 | 1/1981 | Halvorsen | 241/24 |
| 4,484,928 | 11/1984 | Keller, Jr. | 241/20 |
| 4,683,814 | 8/1987 | Plovanich et al. | 100/37 |
| 4,753,660 | 6/1988 | Kellerwessel et al. | 44/51 |

OTHER PUBLICATIONS

M. Cohen et al., *Appl. & Env. Microbiology,* 44:23–27 (1982).

M. Jain et al., *Fuel,* 70:573–576 (1991).

M. Jain et al., *Second Int. Symposium on the Biological Proc. of Coal* pp. 15–21 (1991).

W. Kenealy et al., *Jour. of Bacteriology,* 146:133–140 (1981).

R. Meissner III et al., *Energy Progress,* 4:17–21 (1984).

J. Shinn, *Proc. Int. Conf. on Coal Science,* Pergamon Press, Sydney, N.S.W., pp. 738–741 (1985).

J. Zeikus et al., *Ann. Rev. Microbiol,* 34:432–440 (1980).

*Primary Examiner*—Timothy V. Eley
*Assistant Examiner*—John M. Husar
*Attorney, Agent, or Firm*—Quarles & Brady

[57] ABSTRACT

A method for reducing the size of coal particles includes the steps of inoculating a coal sample with an anaerobic bacteria or decarboxylating enzyme therefrom and incubating the inoculated sample. The microbes and/or decarboxylating enzymes biochemically modify the coal to reduce the size of the coal to ultra-fine particles. The biotreatment modifies the coal so as to improve its dispersibility in coal-water slurries.

3 Claims, 1 Drawing Sheet

BIOLOGICAL METHOD FOR COAL COMMINUTION

TECHNICAL FIELD

The present invention relates to methods of reducing coal particle size. More specifically, the present invention provides a method of biotreatment to reduce coal particle size under ambient conditions.

BACKGROUND OF THE INVENTION

Coal is the most abundant fossil fuel in the United States and comprises about 75% of the total resources of fossil fuels. However, this resource is not a good source of combustible fuel because of low-energy content, poor quality, and the presence of contaminants. It has been recognized that bioprocess technology has potential to convert this coal into an environmentally acceptable, energy-rich fuel with few contaminants. Liquefaction processes currently produce clean fuels from coal. However, these processes operate at high temperatures and pressures, making them unattractive. Conversely, bioprocessing of coal can produce clean fuels at mild temperatures and pressure which are not only safe, but may prove to be economical.

Subbituminous and lignite coals contain high levels of oxygen. A structural comparison of the coals is shown in Table 1[1].

TABLE 1

Structural Comparison of Coals

| Coal Rank | Carbon Aromaticity | Nature of Monomers | Nature of Crosslinks |
|---|---|---|---|
| Lignite | 30–50% | Small, largely single-single-ring systems extensively substituted with 0-functional groups (—COOH, —OH, —$OCH_3$), about one oxygen per 3 to 4 carbon. structural component. | Many hydrogen bonds probably some other cross-links. Possibly salt bonds as in COO—Ca—OOC. Few aliphatic cross-links Gel-like; Water is important |
| Sub-bitum-inous | 60% | Still mostly single rings with some larger rings. About one oxygen per 5 to 6 carbon. | Mixture of hydrogen bonds and probably ethers. Some aliphatic links. |

The key feature of the subbituminous coal is the presence of ether linkages, along with carboxyl groups, as predominant oxygen functional groups. This coal is highly reactive and not the refractory material it was once thought to be. However, under the severe processing conditions of temperature and pressure, the coal undergoes retrogressive condensation reactions resulting in an intractable coal. Thus, this type of coal is most suitable for biological processing, since these processes operate under mild conditions and can provide specific chemical transformations.

Prior art coal bioprocessing has been categorized into two areas. The first area is coal cleaning or the removal of undesirable components, such as sulfur, nitrogen, and trace metals. The second category is coal conversion, which includes microbial liquefaction, gasification, pretreatment, and methane production.

Physical cleaning is achieved by grinding (comminuting) of the coal to liberate impurities like mineral matter and ash that are not chemically bound and then taking advantage of specific gravity differences between the organic matter that formed the coals and the denser mineral impurities. Sometimes differences in surface wetting properties between the coal macerals and impurities are used for separation. The method of comminution generally involves mechanical comminution or grinding. In this method, the grinding is effected by ball or jet milling or any other techniques wherein the coal particles impinge against or are contacted with a solid obstruction. Jet milling, for example, involves entraining coal particles in a gas stream at a high velocity and directing the gas stream against a solid obstruction. Examples of jet milling are described in U.S. Pat. No. 3,897,010 (1975). Specific examples of such jet milling devices include the Micronizer brand fluid energy mill manufactured by Sturtevant Mill Co. and the "Jet-o-Mizer" fluid energy production mill produced by Energy Processing and Equipment Company[3]. Mechanical comminution techniques are frequently used to provide feed coal to a gasification reactor.

Ball milling, jet milling, and other mechanical impingement techniques involve relatively crude forms of comminution. First and most importantly, these techniques do not comminute selectively. That is, they grind both the ash forming minerals, as well as the carbonaceous fraction of the coal. Another disadvantage is that the mechanical grinding techniques do not separate or scission the carbonaceous matter within the coal from the mineral constituents of the coal. That is, ash forming materials generally remain physically attached to the carbonaceous material in the coal after milling to a considerable extent. The minerals thus cannot be removed from the desired carbonaceous fragment of coal. In addition, organic forms of sulfur remain chemically bonded in the hydrocarbon.

Another problem is that much of the energy in the grinding processes is lost or dissipated as heat energy and is not all used in the comminution of the coal particles. For example, the energy consumption for ultra-fine grinding of Illinois No. 6 coal to a particle size of 10 μ varies from 60 to 180 kwh per ton. This is a cost ineffective method.

Coal scientists have been trying to achieve an inexpensive approach to produce a decarboxylated, depolymerized, hydrogen-rich coal. Applicants' previous work has been directed at decarboxylating and reductively depolymerizing the coal under anaerobic conditions[4,5]. Applicants have continued to utilize anaerobic bacteria in fermentor systems and are applying anaerobic bioprocessing to covert a low-rank coal by decarboxylation and biodepolymerization to obtain a better fuel.

Physical coal cleaning is achieved by grinding the coal to liberate impurities that are not chemically bound and then taking advantage of specific gravity differences between the organic matter in coal (the macerals) and denser mineral impurities. It is recognized, however, that in the field of crushing and grinding (comminution):

- Only several percent of the energy applied to the systems is actually used in fracturing the coal. The remainder is dissipated in process inefficiencies.
- Current techniques do not comminute selectively. Both the ash-forming minerals and the carbonaceous fraction of the coal are ground. This results in the fine mineral matter being intimately mixed and dispersed into the organic phase making separations difficult.
- The mechanical grinding techniques do not selectively separate or scission the carbonaceous matter within the coal from the mineral constituents of the coal.
- Current techniques are limited in the degree of size reduction.

Applicants' approach is based on bond cleavage under ambient conditions using microorganisms. It is appropriate to use a reductive approach, rather than an oxidative approach for removal of oxygen from low-rank coals. Oxygen from coal is removed by decarboxylation under reductive conditions in contrast to oxidation of coal under the latter approach.

The biodegradive potential of anaerobic bacteria has seen a tremendous expansion in the last 10–15 years. The prior art view that compounds not degradable aerobically will never be degraded anaerobically is no longer accepted. Most substrates in the presence of oxygen are attacked by oxygenases, which undergo basically different degradation reactions in the absence of oxygen.

Biological treatment with whole cells and isolated enzymes has a potential to yield useful products from low-ranked coals. The solubilization of coal by microorganisms was first reported by M. Cohen et al[6].

While continuing the above-mentioned research, applicants discovered an unexpected reduction in coal particle size during anaerobic biotreatment. This "biogrinding" provides a process for reducing coal particle size which does not require elevated temperatures of the prior art or costly mechanical mechanisms for achieving the same results. Hence, the present invention provides a biotreatment for inexpensively and effectively decreasing coal particle size in a passive process.

Another unexpected observation is that the biotreatment modifies the coal such that the coal particles can remain suspended or dispersed in water for long periods without settling. This is an essential requirement/need for the utilization of coal-water slurries. Current coal-water slurries require the addition of expensive surfactants and other additives to achieve the dispersion of coal in water without settling. As stated earlier, this essential requirement must be met before coal-water slurries can be used.

Further advantage of the process is that only selective reduction in particle size of the carbonaceous component, and not of the mineral matter, in coal occurs during this biotreatment process in contrast to mechanical process where both carbonaceous and mineral matter components are grounded.

SUMMARY OF THE INVENTION

In accordance with the present invention, there is provided a method for reducing the size of coal particles by inoculating a coal sample with microbes and/or decarboxylating enzymes and incubating the inoculated sample. The microbes and/or decarboxylating enzymes biochemically modify the coal to reduce the size of the coal particles and incorporate functionality to allow the coal to be readily dispersed.

BRIEF DESCRIPTION OF THE DRAWINGS

These advantages of the present invention will be readily appreciated as the same becomes better understood by reference to the following detailed description when considered in connection with the accompanying drawings wherein.

DETAILED DESCRIPTION OF THE INVENTION

Figure 1:
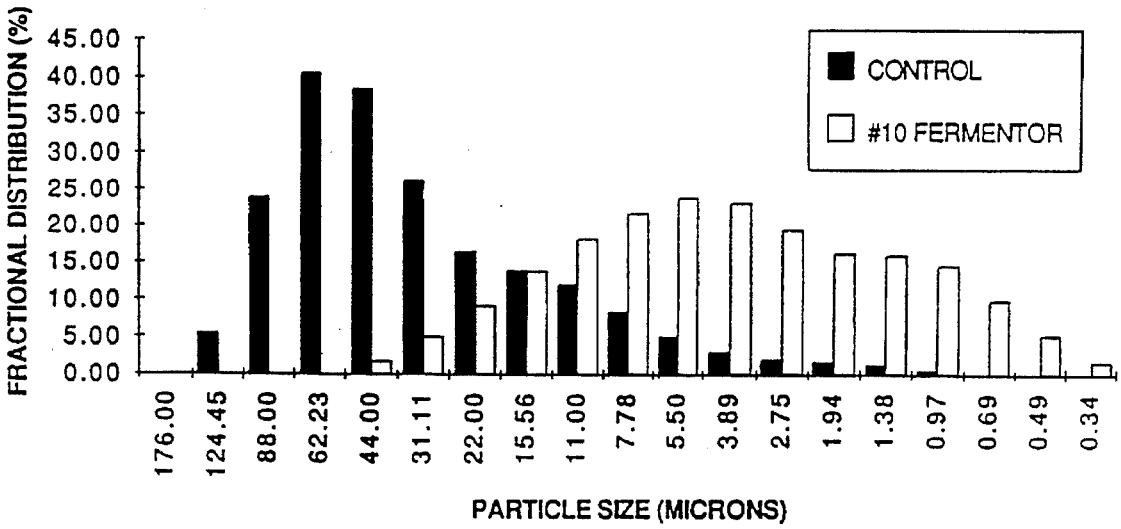
FIG. 1 shows production of ultra-fine coal from 100 mesh coal.
Figure 2:
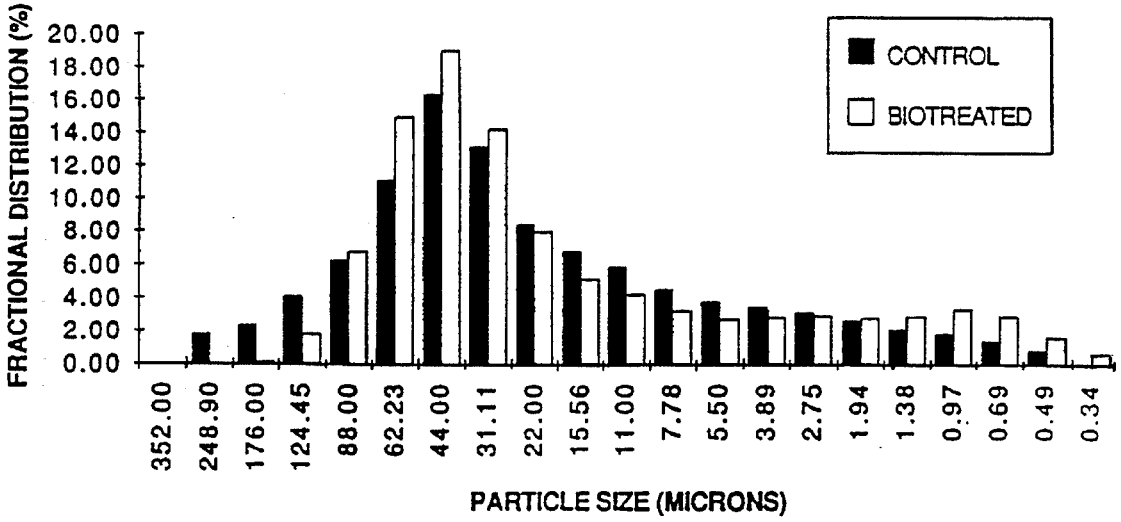
FIG. 2 shows particle size distribution of 20 mesh coal before and after biotreatment.

In general, the present invention provides a method for biogrinding coal particles. Biogrinding is a term of art used to denote the use of microorganisms or their biological products, such as enzymes, for directly modifying coal particles to reduce the size of coal particles. This is a passive process in the sense that once the inoculation is made, the sample of coal is allowed to incubate without requirement of other mechanical treatment, although mechanical treatment can be added to the process.

As the experimental data below demonstrate, the size of the coal particles is reduced by biotreatment. Without being restrictive, decarboxylation under anaerobic conditions is one of the reactions occurring. This can be accomplished by inoculating the sample of coal particles with decarboxylating enzymes under anaerobic conditions or with anaerobic bacteria or the like under anaerobic conditions. The experimental data also show that biotreated coal particles remain suspended in water for long periods of time. Without being restrictive, this is attributed to the introduction of surface functionality during the biotreatment process.

The term "anaerobic conditions" is intended to mean conditions under which anaerobic bacteria can survive and multiply. Such conditions can be accomplished by inoculating a large batch sample of coal wherein the interior of the coal sample is not exposed to the ambient oxygenated environment. This can be accomplished within a bioreacter for maintaining control environmental conditions, as by passing nitrogen gas to the sample or under large batch conditions, such as a coal silo where large amounts of coal are stored. In such batch conditions, as discussed above, coal can be inoculated with the bacteria or enzymes.

Various microbial consortia can be used in accordance with the present invention, preferably those with coal decarboxylation potential. In accordance with the present invention, several such consortia have been developed by selective enrichment methods, using rumen fluid and anaerobic waste sludge as major sources for decarboxylating microorganisms.

Rumen fluid as a prime source for decarboxylating anaerobes was chosen firstly because cattle feed is lignocellulosic in nature (lignin is considered precursor to coal and, therefore, resembles its structural complexities) and secondly because many succinate decarboxylating anaerobic bacteria have been isolated from it. The anaerobic sludge from the waste treatment site was selected because this facility receives a mixture of many unknown chemicals and, thus, a variety of anaerobes tolerant to and active against such chemicals were found in such a system.

Through extensive enrichment and coal decarboxylation experiments, four major microbial consortia were developed in accordance with the present invention which are currently maintained on different media as shown in Table 2.

TABLE 2

Inoculum sources and medium compositions for adapted microbial consortia

| Consortium | Inoculum Source | Phosphate Buffered Basal (PBB) Medium |
|---|---|---|
| RW7 | Rumen + Waste Digestor | 0.4% Sodium Succinate + 0.2% YE |
| LC | Rumen | 0.4% Sodium Lactate + 0.2% $NH_4Cl$ |

TABLE 2-continued

| Inoculum sources and medium compositions for adapted microbial consortia | | |
|---|---|---|
| Consortium | Inoculum Source | Phosphate Buffered Basal (PBB) Medium |
| #34 | Rumen & Waste Digestor | 0.4% Sodium Succinate + 0.2% YE |
| RWNH | Rumen | 0.4% Sodium Succinate + 0.5% YE + 0.2% $NH_4Cl$ |

Specifically, consortium LC utilizes lactate as carbon/energy source and ammonium chloride as its nitrogen source, showing that this new consortium, utilizing coal as the substrate, can be grown in a chemically defined medium.

Those skilled in the art can develop microbial consortia as described in example 1.

The present invention can utilize decarboxylating enzymes alone or in combination with the above-mentioned microbes or the microbes alone. Examples of decarboxylating enzymes are extracellular and membrane-bound enzymes derived from anaerobic bacteria of these microbial consortia. Again, the inoculation of these enzymes would preferably be made under anaerobic conditions.

It is recognized that utilizing the above microbes and enzymes with specific types of coals, various specific enzymes, bacteria, or consortium of microbes may result in higher efficiencies of particle size reduction. Accordingly, those skilled in the art can selectively enrich either the anaerobic bacteria consortium, or enzymes, or a combination of the same to maximize efficiency and productivity for different types of coal particles as demonstrated by the experimental evidence below without undue experimentation, once those skilled in the art understand the essence of the present invention as disclosed herein.

The present invention has advantages over the prior art as the proposed biological treatment can be conducted at ambient conditions or within a range of ambient temperature where coal is otherwise stored. Preferably, the temperature range is between 20° to 40° C.

Likewise, the ambient environment, with regard to alkalinity or acidity, need not be altered from present-day storage conditions. That is, the present invention can be utilized and the results achieved therefrom at substantially neutral PH, preferably between the range of 6 to 8.

The experimental evidence set forth below demonstrates that the present invention achieves greater efficiency with the particle size of the coal being initially smaller. That is, there is increased efficiency with decreased initial particle size of the coal. Accordingly, the present invention can utilize an additional pregrinding step, as achieved by mechanical grinding or the like. The coal can then be treated in accordance with the present invention, thereby not requiring the further energy costs of continued mechanical grinding methods. Preferably, the coal particles can be pre-ground mechanically and then treated in accordance with the present invention.

The experimental data below further demonstrate that mixing of the coal during the incubation step can increase the efficiency of the biogrinding process. Mixing of the coal, such as by mechanical methods, can result in obtaining smaller particle sizes at a faster rate. It is not clear whether this can be attributed to increased efficiency of the biotreatment or to a contribution made directly by the mechanical stirring process to the grinding of the coal. In either event, the combination of the mixing step with the incubation step results in increased efficiency of the biogrinding system.

Mixing can be accomplished by mechanical means, such as a motor-driven mixing rod or other mechanical techniques.

The present invention provides several other benefits inherent in the biotreatment process. For example, the below experimental data show that the biotreated coal showed a higher hydrogen to carbon ratio then the starting coal. This provides a more valuable fuel product. The anaerobic biotreatment also resulted in an increased volatile carbon to fixed carbon ratio, again providing a product having increased value for use as a combustible fuel.

The following experimental data demonstrate the ability of the present invention to be used as a biogrinding process, as well as evidence relating to the mechanism of action of the present invention through a decarboxylase enzymatic system.

EXAMPLE

Microbial consortia to bioprocess coal was developed on a suitable media such as phosphate buffered basal (PBB) medium containing mineral salts, phosphate buffer, vitamins and sulfide as reducing agent[7]. The medium was prepared anaerobically[8] and autoclaved. Upon cooling, a filtered sterilized vitamin solution was added. Coal was added @ 1.5–5%. Yeast extract was added at 0.05–0.2%. Where needed, a supplemental carbon source (such as succinate, lactate, benzoate, etc.) was added at 0.2–0.4%. The initial pH of the medium was adjusted to about 7.0.

The culture development was carried out in anaerobic pressure tubes (Bellco Glass, Inc., Vineland, N.J.) or vials (Bellco Glass, Inc., Vineland, N.J.). Gases ($N_2$ and $CO_2$) and gas mixture $N_2$-$H_2$ (95:5) were passed over heated copper filings to remove traces of oxygen before use. Anaerobic microbial inocula to develop this consortia was obtained from a suitable ecological niche or site such as rumen, wet wood of tree, waste treatment site receiving chemicals or sewage sludge. Media containing coal was inoculated @ 10% with the anaerobic sludge obtained from either of these sites and the incubation was carried out at 37° C. under shaking conditions. Development of microbial consortia was followed microscopically, as well as by production of $CO_2$ gas in the head space. A fermentor was also used to develop the microbial consortia using PBB medium and coal as described for tubes and vials.

EXPERIMENTAL DATA

Loss of Carboxyl Groups in Biotreated Coals Confirmed by FT-IR Analysis

Biotreated coals from fermentors as well as tubes were washed with acid to remove biomass and then methylated for FT-IR analysis. As presented in Table 3, all coal sample treated under anaerobic conditions exhibited decrease in carboxyl groups, irrespective of inoculum source.

TABLE 3

FT-IR Analysis of Methylated Biocoals

| Sample | Wave Number Range | Peak Area | % Gain (+)/Loss (–) |
|---|---|---|---|
| | C=O Region | | |
| Coal without inoculum | 1782.5–1679.8 | $2.23 \times 10^4$ | — |
| Coal + inoculum (R2) | 1788.0–1678.8 | $2.31 \times 10^4$ | — |
| Coal from vial with WD1B | 1779.2–1680.5 | $1.99 \times 10^4$ | –10.8 |
| Control coal (Coal + 2 × R2)* | | $2.39 \times 10^4$ | |
| Coal from tube, + 2 × R2 (5 wk) | 1779.7–1680.9 | $1.98 \times 10^4$ | –17.2 |
| Coal from tube, + 2 × R2 + Succinate (5 wk) | 1779.3–1679.4 | $2.15 \times 10^4$ | –10.0 |
| Coal from tube, + 2 × R2 + Benzoate (5 wk) | 1782.1–1680.0 | $1.87 \times 10^4$ | –21.8 |
| | C – O Region | | |
| Coal without inoculum | 1389.8–1129.2 | $4.78 \times 10^4$ | — |
| Coal + inoculum (R2) | 1393.0–1128.2 | $5.26 \times 10^4$ | — |
| Coal from vial with WD1B | 1391.2–1131.7 | $4.00 \times 10^4$ | |
| Control coal (Coal + 2 × R2)* | | $5.74 \times 10^4$ | — |
| Coal from tube, + 2 × R2 (5 wk) | 1392.5–1130.6 | $4.72 \times 10^4$ | –17.8 |
| Coal from tube, + 2 × R2 + Succinate (5 wk) | 1392.8–1132.8 | $5.30 \times 10^4$ | –7.7 |
| Coal from tube, + 2 × R2 + Benzoate (5 wk) | 1391.0–1130.6 | $4.77 \times 10^4$ | –16.9 |

*Calculated from the result of (Coal + R2)

Biotreated Coal Showed a Higher H/C Ratio than the Starting Coal

Anaerobically biotreated coals have shown increase in their H/C content up to a maximum of 4.5% (Table 4).

TABLE 4

CHN analysis of biotreated coals from the batch fermentor systems (#3–#6).

| Batch # | C (%) | H (%) | N (%) | H/C ratio | % Change in H/C ratio |
|---|---|---|---|---|---|
| Control coal | 68.59 | 5.06 | 1.05 | 0.885 | — |
| #3 fermentor | 68.19 | 5.11 | 0.59 | 0.899 | +1.58 |
| Control coal | 68.58 | 5.04 | 0.68 | 0.882 | — |
| #4 fermentor | 68.71 | 5.10 | 0.92 | 0.891 | +1.00 |
| Control coal | 65.94 | 4.60 | 1.06 | 0.837 | — |
| #5 fermentor | 66.70 | 4.71 | 1.15 | 0.847 | +1.4 |
| #6 fermentor | 66.80 | 4.87 | 1.31 | 0.875 | +4.5 |

Reduction in Oxygen Content in Biotreated Coals Shown.

Anaerobically biotreated coals have shown reduction in their oxygen content by about 3.8% (Table 5).

TABLE 5

Removal of Oxygen from Coal by Anaerobic Biotreatment in Batch Fermentor Systems

| Fermentor | #3 | #4 | #5 | #6 |
|---|---|---|---|---|
| % Oxygen removal | 3.6 | 3.8 | 0.7 | 3.1 |

Reduction up to 5% of O/C Ratio in the Biotreated Coal Shown

The O/C ratio of the biotreated coal was reduced by about 4.8% (Table 6).

TABLE 6

Reduction of O/C ratio in coal by anaerobic biotreatment in batch fermentor systems

| Fermentor | #3 | #4 | #5 | #6 |
|---|---|---|---|---|
| % Reduction of O/C ratio | 4.2 | 4.8 | 1.8 | 4.1 |

Anaerobic Biotreatment of Coal Increased Its Volatile Carbon to Fixed Carbon Ratio Thermogravimetric analysis (TGA) was performed to determine any impact that anaerobic bioprocessing would have on volatilization and retrogressive condensation reaction that occur during the coal liquefaction process. One hypothesis was that carboxyl groups are involved in hydrogen bonding and chelate cross-linking; and because decarboxylation occurs at only elevated temperature, the polymer chain cannot escape from the matrix before undergoing retrogressive condensation reaction, i.e. there is a competition between evolution of polymer chains from the matrix and the retrogressive reaction and the equilibrium always occurs towards retrogressive reaction. Elimination of carboxyl group would allow the polymer chain to pull off the matrix without undergoing significant retrogressive reaction. Biotreated coals were carefully collected as homogeneous as possible after dismantling the batch fermentors and analyzed using TG analyzer. During the TG analysis as the temperature reached near 900° C., more volatiles were evolved from the biotreated coals.

Results presented in Table 7 demonstrate increase in volatile carbon to fixed carbon ratio in the biotreated coals. These results indicate that the retrogressive condensation reaction in the biotreated coal will be reduced significantly.

TABLE 7

Thermogravimetric analysis of biotreated coals using a TG analyzer

| Sample* | % Moisture | % Volatile carbon (VC) | % Fixed carbon (FC) | % Ash | VC/FC ratio | % Change in VC/FC ratio |
|---|---|---|---|---|---|---|
| Control coal | 1.14 | 47.18 | 43.53 | 8.15 | 1.084 | — |
| #3 fermentor coal | 6.19 | 48.97 | 37.89 | 6.95 | 1.292 | +19.24 |
| #4 fermentor coal | 0.16 | 49.69 | 41.07 | 9.08 | 1.210 | +11.62 |
| Control coal | 0.54 | 46.60 | 43.18 | 9.68 | 1.079 | — |
| #5 fermentor coal | 4.56 | 47.66 | 38.94 | 8.84 | 1.224 | +13.42 |
| #6 fermentor coal | 4.24 | 45.70 | 41.25 | 8.81 | 1.108 | +2.67 |

Preliminary Study on Decarboxylase Enzyme Activity Conducted

To investigate the mechanism of the coal decarboxylation reaction, a preliminary enzyme study was conducted using *Propionibacterium acidipropionici*. Washed whole cells gave about 1.5 times increase in $CO_2$ production in the presence of 5% coal, suggesting that enzyme reaction probably occurs by the direct contact of cells with coal particles. It seems that coal decarboxylation is due to either an extracellular or cell-bound enzyme or both.

Significant Reduction of Coal Particle Size During the Biotreatment Observed

There was a progressive reduction in coal particle size during batch fermentation of 100 mesh coal. After 6 weeks of treatment, there were clear differences in reduction in coal particles (FIG. 1) and in the sedimentation profiles of biotreated coals and control coal. Control coal showed clear separation of coal particle from the supernatant, while biotreated coal showed very slow separation of coal particles, even after 24 hours. Only a small fraction of the clear supernatant liquid was observed at the top of the culture broth in the biotreated cultures. This phenomena was more remarkably observed when 20 mesh coal (from Penn State Coal Sample Program) was treated with microbial consortium RW for 42 days. These results strongly suggest that there is a significant particle size reduction of coal due to biotreatment.

Batch fermentation systems containing 20 g of coal were also monitored for reduction of coal particle size by microbial consortium in comparison to control coal without the inoculum. To minimize the mechanical grinding effect caused by the motion of a magnetic impeller shaft, a magnetic bar stirring was provided at 120 rpm for batch fermentor. Constant stream of $N_2$ gas was provided to ensure anaerobic condition and to trap the evolved $CO_2$ from the coal. Sample coals were withdrawn from the fermentors weekly and the picture of biotreated coals and control coal were taken under the microscope. The reduction of coal particles could be observed soon after one week; after three weeks, there were almost no big coal particles observed. It is likely that slow agitating motion of a magnetic bar could contribute to partial particle size reduction of control coal and biotreated coal as well. Since the reduction in particle size was brought about by decarboxylating microbial consortia, it could be argued that there is a relationship between decarboxylation and coal particle size reduction.

The experimental data demonstrate the effectiveness of the present invention, as well as a demonstration of the mechanism of action by which the microbes and/or enzymes decarboxylate the coal particles to break the particles to smaller sizes. The data further demonstrate that the resulting coal particles have properties preferred over the original coal particles.

The invention has been described in an illustrative manner, and it is to be understood the terminology used is intended to be in the nature of description rather than of limitation.

Many modifications and variations of the present invention are possible in light of the above teachings. Therefore, it is to be understood that within the scope of the appended claims, wherein reference numerals are merely for convenience and are not to be in any way limiting, the invention may be practiced otherwise than as specifically described.

We claim:

1. In a method of reducing coal pieces to ultrafine particles suitable for use in coal water slurries, the improvement which comprises inoculating coal pieces having a mesh size of about 20 to about 100 with an anaerobic microorganism, which produces a decarboxylating enzyme, and incubating said pieces and microorganism under anaerobic conditions at a temperature of about 20° C. to about 40° C. until the coal pieces have been reduced to ultrafine particles.

2. The method of claim 1 in which the incubation is conducted at a pH of 6 to 8.

3. Ultrafine particles of coal made by the method, of claim 1, said particles being suspendable in water without the use of surfactants.

* * * * *